US011976654B1

(12) United States Patent
Hashimoto et al.

(10) Patent No.: US 11,976,654 B1
(45) Date of Patent: May 7, 2024

(54) SCROLL COMPRESSOR

(71) Applicant: KABUSHIKI KAISHA TOYOTA JIDOSHOKKI, Aichi (JP)

(72) Inventors: Yuji Hashimoto, Aichi (JP); Hideharu Yamashita, Aichi (JP); Kazunari Honda, Aichi (JP); Akihiro Nakashima, Aichi (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 0 days.

(21) Appl. No.: 18/277,473

(22) PCT Filed: Feb. 24, 2022

(86) PCT No.: PCT/JP2022/007714
§ 371 (c)(1),
(2) Date: Aug. 16, 2023

(87) PCT Pub. No.: WO2022/202084
PCT Pub. Date: Sep. 29, 2022

(30) Foreign Application Priority Data

Mar. 26, 2021 (JP) ..... 2021-053848

(51) Int. Cl.
*F04C 18/02* (2006.01)
*F04C 15/00* (2006.01)
(Continued)

(52) U.S. Cl.
CPC ..... *F04C 18/0215* (2013.01); *F04C 27/005* (2013.01); *F04C 29/005* (2013.01); *F04C 23/008* (2013.01)

(58) Field of Classification Search
CPC ..... F04C 18/0215; F04C 18/0253; F04C 27/005; F04C 29/00; F04C 15/0003; F04C 27/02; F04C 23/008
See application file for complete search history.

(56) References Cited

U.S. PATENT DOCUMENTS 4,435,137 A * 3/1984 Terauchi ..... F04C 29/0021 418/57
2002/0085938 A1* 7/2002 Gennami ..... F04C 23/008 418/188
(Continued)

FOREIGN PATENT DOCUMENTS

JP 2002-202074 A 7/2002
JP 2004-293507 A 10/2004
(Continued)

OTHER PUBLICATIONS

International Search Report in WIPO Patent Application No. PCT/JP2022/007714, dated Mar. 29, 2022, along with an English translation thereof.

*Primary Examiner* — Deming Wan
(74) *Attorney, Agent, or Firm* — Greenblum & Bernstein, P.L.C.

(57) ABSTRACT

A collar of a fixed scroll includes a gasket contact surface with which a gasket comes into contact, and a metal contact surface that causes the collar and a compression housing to be in contact and receives the axial force of bolts. The collar has a protruding portion that protrudes in the axial direction relative to the gasket contact surface, and the metal contact surface is disposed on the protruding portion.

4 Claims, 5 Drawing Sheets

(51) Int. Cl.

| | |
|---|---|
| ***F04C 23/00*** | (2006.01) |
| ***F04C 27/00*** | (2006.01) |
| ***F04C 29/00*** | (2006.01) |

(56) References Cited

U.S. PATENT DOCUMENTS

| | | | | |
|---|---|---|---|---|
| 2002/0102172 | A1* | 8/2002 | Gennami | F04C 27/005 418/57 |
| 2019/0376518 | A1 | 12/2019 | Tateno et al. | |
| 2021/0159750 | A1* | 5/2021 | Naruta | H02K 3/30 |

FOREIGN PATENT DOCUMENTS

| | | | |
|---|---|---|---|
| JP | 2004-300975 | A | 10/2004 |
| JP | 2009-115101 | A | 5/2009 |
| WO | WO2018/056152 | A1 | 3/2018 |

* cited by examiner

SCROLL COMPRESSOR

CROSS REFERENCE TO RELATED APPLICATION

This application is a National Stage of International Application No. PCT/JP2022/007714 filed on Feb. 24, 2022, claiming priority based on Japanese Patent Application No. 2021-053848 filed on Mar. 26, 2021, the contents of all of which are incorporated herein by reference in their entirety.

TECHNICAL FIELD

The present disclosure relates to a scroll compressor.

BACKGROUND ART

An outline of a scroll compressor disclosed in Patent Literature 1 is formed by connecting a rear housing, a front housing, and a motor housing with bolts. A fixed scroll including a plate and a spiral portion is formed integrally with the rear housing.

A movable scroll serving as an orbiting scroll including a plate and a spiral portion is accommodated in a space surrounded by the rear housing and the front housing. The spiral portion of the movable scroll is meshed with the spiral portion of the fixed scroll. A clearance is formed between a distal end surface of the spiral portion of the movable scroll and the plate of the fixed scroll, and a clearance is formed between a distal end surface of the spiral portion of the fixed scroll and the plate of the movable scroll. That is, the scroll compressor has a clearance between the fixed scroll and the movable scroll.

A gasket seal is interposed between joint surfaces of the rear housing and the front housing. The gasket seal is formed of an iron plate corresponding to a shape of the joint surfaces. A continuous protrusion is provided on a seal surface of the gasket seal. A plurality of holes into which bolts for connecting the rear housing, the front housing, and the motor housing are inserted, respectively, are formed at four corners of the gasket seal.

At a time of assembling of the scroll compressor, the gasket seal is inserted between the joint surfaces of the rear housing and the front housing, and then tightened with the plurality of bolts. Such tightening holds a crimping force while the protrusion is deformed to some extent, so that a sufficient sealing effect is exerted.

CITATION LIST

Patent Literature

Patent Literature 1: Japanese Patent Application Publication No. 2002-202074

SUMMARY OF INVENTION

Technical Problem

However, when a tightening force with the bolts varies, a clearance between the fixed scroll and the orbiting scroll varies to cause variations in a performance of the scroll compressor.

Solution to Problem

A scroll compressor for solving the above-described problems includes: a rotary shaft; a fixed scroll; an orbiting scroll revolving relative to the fixed scroll; a compression housing accommodating the fixed scroll and the orbiting scroll; a discharge housing disposed at a position opposite to the compression housing such that a collar of the fixed scroll is sandwiched by the discharge housing and the compression housing; a gasket sandwiched by the collar and the compression housing to seal a gap between the collar and the compression housing; and a plurality of bolts fixing the compression housing, the fixed scroll, and the discharge housing in an axial direction of the rotary shaft. Each of the collar and the compression housing includes a gasket contact surface with which the gasket is in contact, and a metal contact surface on which the collar and the compression housing are in contact with each other to receive an axial force of each of the bolts. At least one of the collar and the compression housing includes a protruding portion protruding in the axial direction relative to the gasket contact surface. The metal contact surface is disposed on the protruding portion.

Thus, the fixed scroll and the compression housing are fixed to each other in a state of approaching each other, due to the tightening with the plurality of bolts. The gasket disposed between the gasket contact surface of the collar and the gasket contact surface of the compression housing is deformed to some extent while being in contact with both the gasket contact surfaces.

The gasket contact surface of the collar and the gasket contact surface of the compression housing are spaced from each other in the axial direction by the protruding portion protruding from at least one of the gasket contact surfaces. Since the protruding portion protrudes from the gasket contact surface by a constant amount of protrusion, a distance between the gasket contact surfaces is constant. Then, the metal contact surface receives the axial force of each of the bolts, so that the distance between the gasket contact surfaces is kept constant even when the axial force varies. As a result, a clearance between the fixed scroll and the orbiting scroll is kept constant. Thus, variations in a performance of the scroll compressor can be suppressed.

In the scroll compressor, each of the compression housing, the fixed scroll, and the discharge housing may include a plurality of bolt insertion holes through which the plurality of bolts are inserted, respectively. Each of the bolt insertion holes may be opened in the metal contact surface of the protruding portion.

Thus, the metal contact surface of the protruding portion can be formed around the bolt insertion holes, respectively. The bolt insertion holes are portions required when the compression housing, the fixed scroll, and the discharge housing are fixed to each other with the bolts, and each have an existing structure in the scroll compressor. Since the protruding portion and the metal contact surface are provided utilizing such an existing structure, variations in the performance of the scroll compressor are suppressed while suppressing an increase in a size of the scroll compressor.

In the scroll compressor, the bolt insertion holes may be disposed outside an outer circumferential edge of the gasket.

Thus, airtightness of the bolt insertion holes need not be ensured, so that the number of components of the scroll compressor does not increase.

The scroll compressor may include a discharge gasket sandwiched between the fixed scroll and the discharge housing to seal a gap between the fixed scroll and the discharge housing. Each of the fixed scroll and the discharge housing may include a discharge gasket contact surface with which the discharge gasket is in contact. The fixed scroll may include a discharge protruding portion protruding toward the discharge housing in the axial direction relative to the discharge gasket contact surface, and a discharge metal contact surface on which the discharge protruding portion is in contact with the discharge housing to receive an axial force of each of the bolts may be disposed in the discharge protruding portion.

Accordingly, since the discharge housing is fixed with the bolts, the axial force of the bolts is also applied to the discharge housing. At this time, since the discharge metal contact surface receives the axial force of the bolts, deformation of the discharge housing due to the axial force of the bolts can be suppressed.

Advantageous Effects of Invention

According to the present disclosure, variations in a performance of a scroll compressor can be suppressed.

DESCRIPTION OF EMBODIMENTS

Hereinafter, a scroll compressor according to an embodiment will be described with reference to FIG. 1 to FIG. 7. The scroll compressor of the present embodiment is used for a vehicle air conditioner, for example.

Figure 1:
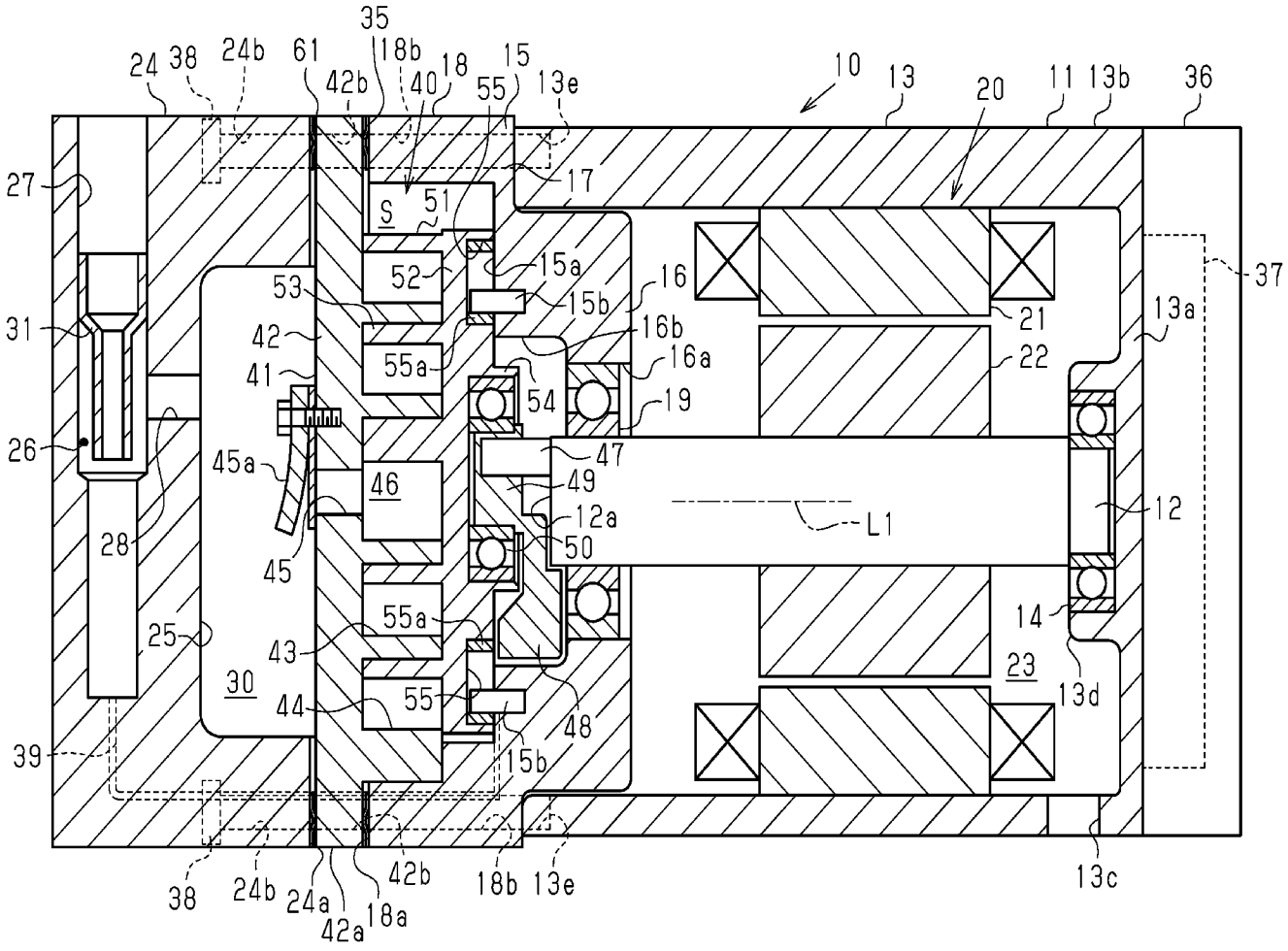
FIG. 1 is a cross-sectional view of a scroll compressor according to an embodiment.

As illustrated in FIG. 1, a scroll compressor 10 includes a housing 11 having a rectangular tubular shape, a rotary shaft 12 accommodated in the housing 11, an electric motor 20 that rotates the rotary shaft 12, and a compression mechanism 40 that is driven in response to the rotation of the rotary shaft 12.

The housing 11 includes a motor housing 13, a compression housing 15, a discharge housing 24, a collar 42*a* of a fixed scroll 41, and an inverter cover 36. The motor housing 13, the compression housing 15, the discharge housing 24, and the collar 42*a* of the fixed scroll 41 are fixed to each other with a plurality of bolts 38.

The scroll compressor 10 includes a gasket 35 sandwiched between the compression housing 15 and the collar 42*a*, and a discharge gasket 61 sandwiched between the discharge housing 24 and the collar 42*a*.

The motor housing 13 has an end wall 13*a* having a plate shape, a peripheral wall 13*b* extending in a rectangular tubular shape from an outer circumferential edge of the end wall 13*a*, a suction port 13*c* provided in the peripheral wall 13*b*, and a boss portion 13*d* provided on the end wall 13*a*. An axial direction of the peripheral wall 13*b* coincides with an axial direction of the rotary shaft 12.

The suction port 13*c* from which refrigerant as fluid is drawn into an inside of the housing 11 is provided. The suction port 13*c* is disposed in the peripheral wall 13*b*. The boss portion 13*d* cylindrically protrudes from an inner surface of the end wall 13*a* toward the inside of the housing 11. A distal end surface of the peripheral wall 13*b* is in contact with the compression housing 15. First bolt insertion holes 13*e* are provided at four corners of the peripheral wall 13*b*, respectively. Each of the first bolt insertion holes 13*e* is recessed from the distal end surface of the peripheral wall 13*b*. The first bolt insertion holes 13*e* of the motor housing 13 have internal threads, respectively.

The compression housing 15 is sandwiched between the distal end surface of the peripheral wall 13*b* and the collar 42*a* of the fixed scroll 41. The compression housing 15 includes a shaft support portion 16 having a cylindrical shape, a flange 17 extending in a radial direction from an outer peripheral surface of the shaft support portion 16, and a chamber forming peripheral wall 18 extending in a rectangular tubular shape from an outer circumferential edge of the flange 17.

The shaft support portion 16 has a small diameter hole 16*a* and a large diameter hole 16*b* whose diameter is larger than the small diameter hole 16*a*, in a central portion of the shaft support portion 16. The small diameter hole 16*a* is disposed closer to the end wall 13*a* than the large diameter hole 16*b* is.

The compression housing 15 has a facing surface 15*a* on an end surface of the shaft support portion 16 in which the large diameter hole 16*b* is opened. The compression housing 15 includes four anti-rotation pins 15*b* protruding from the facing surface 15*a*. The anti-rotation pins 15*b* are arranged around the large diameter hole 16*b* at regular intervals.

Figure 2:
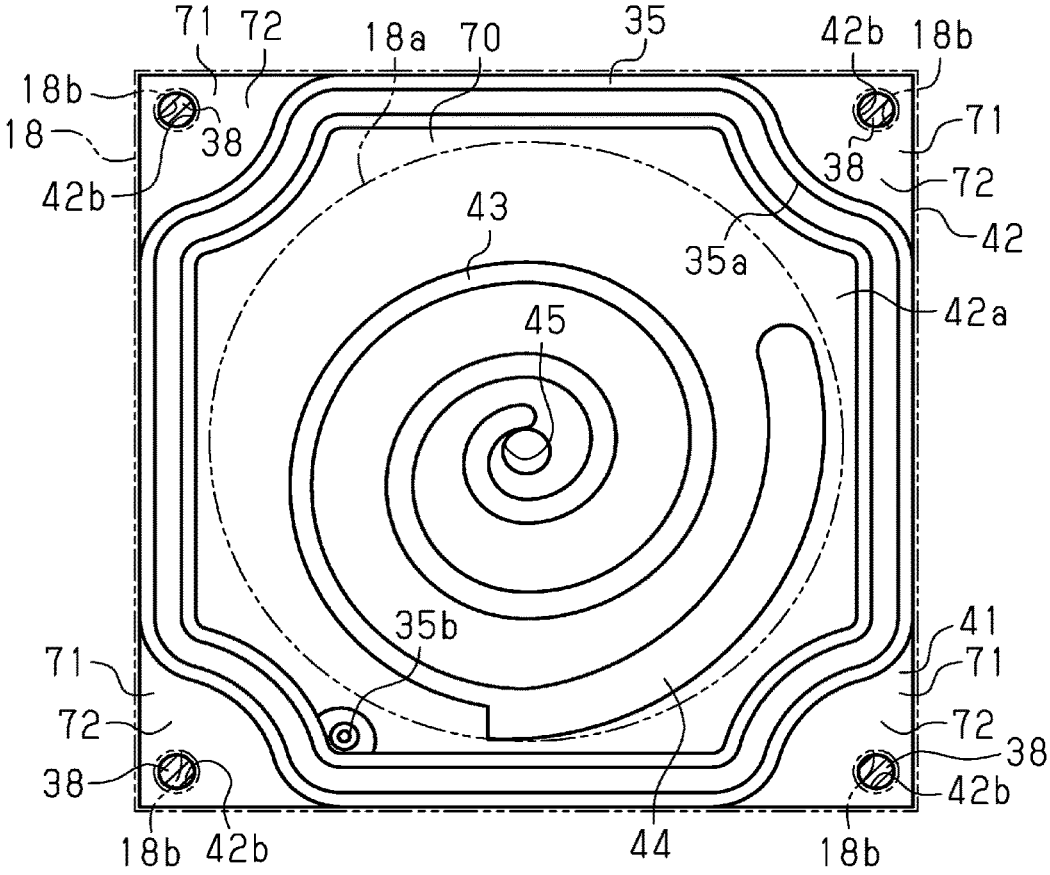
FIG. 2 is a drawing of a collar and a gasket.
Figure 5:
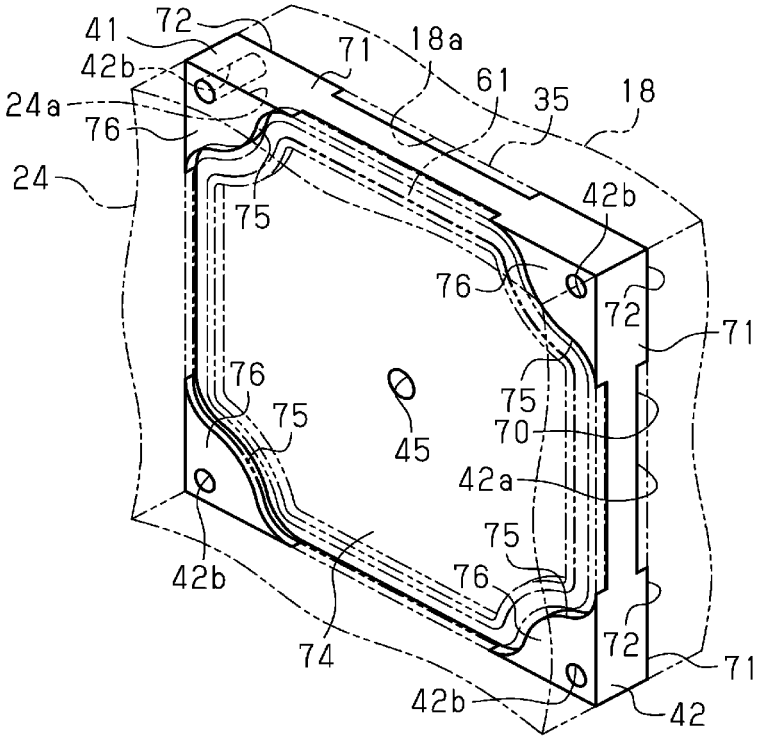
FIG. 5 is a perspective view of the collar, the gasket, and a chamber forming peripheral wall.

As indicated by two-dot chain lines in FIGS. 2 and 5, in the compression housing 15 as seen in the axial direction of the rotary shaft 12, an inner surface of the chamber forming peripheral wall 18 has a circular shape, and an outer surface of the chamber forming peripheral wall 18 has a rectangular shape. The gasket 35 is sandwiched by a distal end surface 18*a* of the chamber forming peripheral wall 18 and a gasket contact surface 70 of the collar 42*a*. The gasket 35 is sandwiched by the collar 42*a* and the compression housing 15 to seal a gap between the collar 42*a* and the compression housing 15. Second bolt insertion holes 18*b* are formed at four corners of the chamber forming peripheral wall 18 and opened in the distal end surface 18*a*. The second bolt insertion holes 18*b* extend through the chamber forming peripheral wall 18.

The gasket 35 has an endless frame shape. The gasket 35 has a rectangular shape with four corners being recessed. The gasket 35 has a first bead 35*a*. The first bead 35*a* is a protrusion protruding from one surface toward the other surface of the gasket 35 in a thickness direction of the gasket 35. The first bead 35*a* is endless over the entire circumference of the gasket 35.

Figure 3:
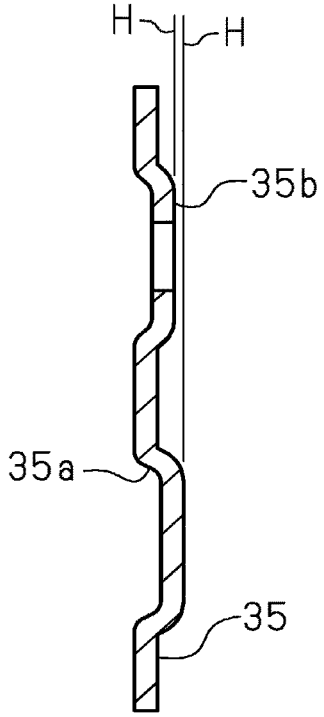
FIG. 3 is an enlarged view of a part of the gasket.

As illustrated in FIG. 3, the gasket 35 has a second bead 35*b*. The second bead 35*b* has a cylindrical shape and protrudes from one surface toward the other surface of the gasket 35 in the thickness direction of the gasket 35. A protruding amount of the second bead 35*b* protruding from the one surface toward the other surface of the gasket 35 in the thickness direction of the gasket 35 is smaller than the protruding amount of the first bead 35*a*. FIG. 3 indicates auxiliary lines H for the purpose of clarity of the protruding amounts of the first bead 35*a* and the second bead 35*b*.

As illustrated in FIG. 1, the motor housing 13 and the compression housing 15 define a motor chamber 23 inside the housing 11. Thus, the scroll compressor 10 includes the motor chamber 23. The motor chamber 23 accommodates the electric motor 20. Refrigerant is drawn into the motor chamber 23 that is the inside of the housing 11, from an external refrigerant circuit (not illustrated) via the suction port 13*c*. Thus, the motor chamber 23 is a suction pressure area.

The electric motor 20 includes a stator 21 and a rotor 22 disposed inside the stator 21. The rotor 22 rotates integrally with the rotary shaft 12. The stator 21 surrounds the rotor 22.

A first end portion of the rotary shaft 12 in the axial direction of the rotary shaft 12 is inserted in the boss portion 13*d*. A bearing 14 is provided between an inner peripheral surface of the boss portion 13*d* and a peripheral surface of the first end portion of the rotary shaft 12. The first end portion of the rotary shaft 12 is supported in the motor housing 13 via the bearing 14.

A second end portion of the rotary shaft 12 is inserted into the small diameter hole 16*a* and the large diameter hole 16*b*. An end surface 12*a* of the second end portion of the rotary shaft 12 is positioned inside the shaft support portion 16. A bearing 19 is provided between a peripheral surface of the second end portion of the rotary shaft 12 and an inner peripheral surface of the compression housing 15 in the small diameter hole 16*a*. The rotary shaft 12 is rotationally supported in the compression housing 15 via the bearing 19.

The discharge housing 24 includes a chamber forming recess 25, an oil separation chamber 26, a discharge port 27, and a discharge hole 28.

Figure 4:
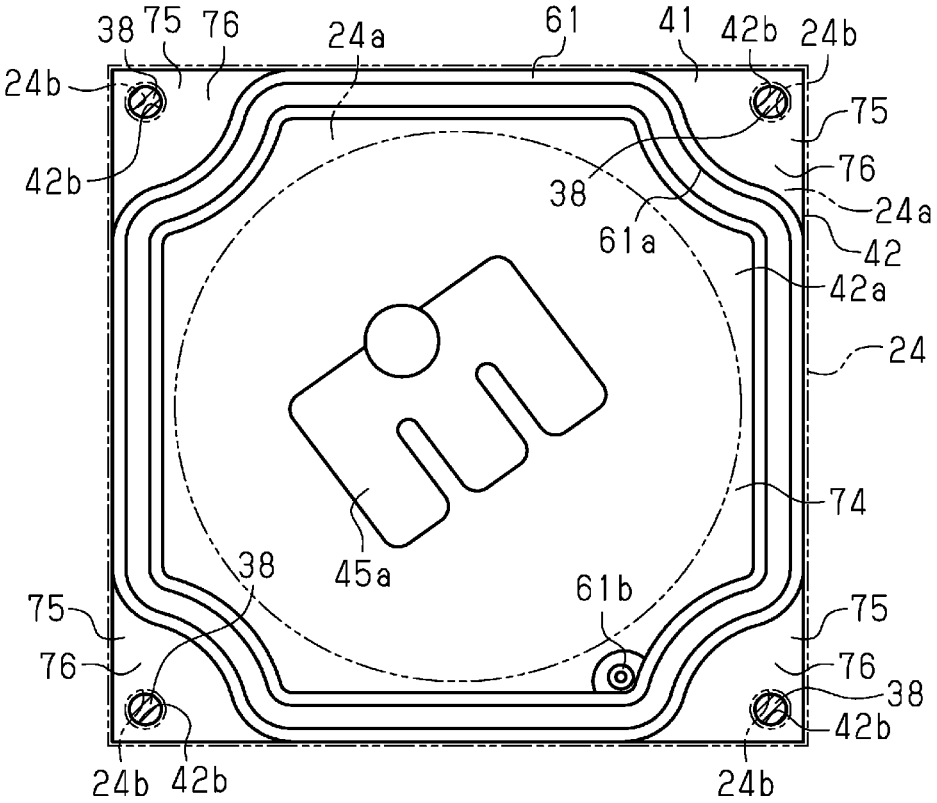
FIG. 4 is a drawing of the collar and a discharge gasket.

As indicated by two-dot chain lines in FIGS. 4 and 5, in the discharge housing 24 as seen in the axial direction of the rotary shaft 12, an inner surface of the discharge housing 24 has a circular shape, and an outer surface of the discharge housing 24 has a rectangular shape. The discharge housing 24 has an end surface 24*a* close to the collar 42*a*. The discharge gasket 61 is sandwiched by the end surface 24*a* and a discharge gasket contact surface 74 of the collar 42*a*. The discharge gasket 61 is sandwiched between the fixed scroll 41 and the discharge housing 24 to seal a gap between the fixed scroll 41 and the discharge housing 24. Third bolt insertion holes 24*b* are formed at four corners of the discharge housing 24 and opened in the end surface 24*a*. The third bolt insertion holes 24*b* extend through the discharge housing 24.

The discharge gasket 61 has an endless frame shape. The discharge gasket 61 has a rectangular shape with four corners being recessed. The discharge gasket 61 has a first bead 61*a*. The first bead 61*a* is a protrusion protruding from one surface toward the other surface of the discharge gasket 61 in a thickness direction of the discharge gasket 61. The first bead 61*a* is endless over the entire circumference of the discharge gasket 61.

The discharge gasket 61 has a second bead 61*b*. The second bead 61*b* has a cylindrical shape and protrudes from one surface toward the other surface of the discharge gasket 61 in the thickness direction of the discharge gasket 61. A protruding amount of the second bead 61*b* protruding from the one surface toward the other surface of the discharge gasket 61 in the thickness direction of the discharge gasket 61 is smaller than the protruding amount of the first bead 61*a*.

As illustrated in FIG. 1, the chamber forming recess 25 is recessed from the end surface 24*a* of the discharge housing 24. A discharge chamber 30 is defined in a space surrounded by the chamber forming recess 25 and a fixed plate 42. Thus, the scroll compressor 10 includes the discharge chamber 30.

The discharge port 27 is connected to an external refrigerant circuit (not illustrated). The oil separation chamber 26 is connected to the discharge port 27. An oil separator cylinder 31 is provided in the oil separation chamber 26. The discharge chamber 30 and the oil separation chamber 26 are connected to each other through the discharge hole 28.

The inverter cover 36 is attached to the end wall 13*a* of the motor housing 13. An inverter device 37 is accommodated in a space defined by the inverter cover 36 and the end wall 13*a* of the motor housing 13. The scroll compressor 10 includes the inverter device 37. The inverter device 37 drives the electric motor 20.

The compression mechanism 40 accommodated in the compression housing 15 includes the fixed scroll 41 and an orbiting scroll 51 facing the fixed scroll 41. The fixed scroll 41 and the orbiting scroll 51 are disposed at a position opposite to the motor chamber 23 across the shaft support portion 16 of the compression housing 15.

The fixed scroll 41 includes a fixed plate 42 having the collar 42*a*, a fixed spiral wall 43 extending straight from the fixed plate 42, a fixed outer peripheral wall 44, and a discharge hole 45. Thus, the fixed scroll 41 includes the collar 42*a*.

As illustrated in FIG. 2 and FIG. 4, the fixed plate 42 has a rectangular plate shape. The collar 42*a* corresponds to an outer peripheral portion of the fixed plate 42, closer to an outer periphery of the fixed plate 42 than the fixed spiral wall 43 and the fixed outer peripheral wall 44 are. In other words, the collar 42*a* corresponds to a part of the fixed plate 42 facing the distal end surface 18*a* of the chamber forming peripheral wall 18. Fourth bolt insertion holes 42*b* are formed at the four corners of the collar 42*a*, respectively. The fourth bolt insertion holes 42*b* extend through the collar 42*a* in the thickness direction of the collar 42*a*. The discharge hole 45 is disposed in a central portion of the fixed plate 42. The discharge hole 45 has a round hole shape. The discharge hole 45 extends through the fixed plate 42 in the thickness direction of the fixed plate 42. A discharge valve mechanism 45*a* that opens and closes the discharge hole 45 is attached to an end surface of the fixed plate 42 opposite to the orbiting scroll 51.

The collar 42*a* is sandwiched by the distal end surface 18*a* of the chamber forming peripheral wall 18 of the compression housing 15 and the end surface 24*a* of the discharge housing 24. Thus, the discharge housing 24 is disposed at a position opposite to the compression housing 15 such that the collar 42*a* of the fixed scroll 41 is sandwiched by the discharge housing 24 and the compression housing 15.

As illustrated in FIG. 1, the bolts 38 are inserted into the third bolt insertion holes 24*b* of the discharge housing 24, the fourth bolt insertion holes 42*b* of the collar 42*a*, the second bolt insertion holes 18*b* of the chamber forming peripheral wall 18, and the first bolt insertion holes 13*e* of the peripheral wall 13*b*, respectively. The bolts 38 are screwed into the internal threads of the first bolt insertion holes 13*e*, respectively. As a result, the discharge housing 24, the discharge gasket 61, the fixed scroll 41, the gasket 35, the compression housing 15, and the motor housing 13 are in contact with and fixed to each other in the axial direction of the rotary shaft 12. Thus, the scroll compressor 10 includes the plurality of bolts 38 fixing the compression housing 15, the collar 42*a*, and the discharge housing 24 in the axial direction of the rotary shaft 12.

In the housing 11, an accommodation chamber S is defined between the fixed scroll 41, the shaft support portion 16 of the compression housing 15, and the chamber forming peripheral wall 18. The orbiting scroll 51 is tumably accommodated in the accommodation chamber S. Thus, the compression housing 15 accommodates the orbiting scroll 51 and the fixed scroll 41.

The fixed spiral wall 43 extends straight from the fixed plate 42 toward the orbiting scroll 51. The fixed outer peripheral wall 44 cylindrically extends straight from the outer periphery of the fixed plate 42. The fixed outer peripheral wall 44 surrounds the fixed spiral wall 43. The fixed outer peripheral wall 44 has an introduction recess (not illustrated).

The orbiting scroll 51 includes an orbiting plate 52, an orbiting spiral wall 53, a boss portion 54, and four recessed portions 55.

The orbiting plate 52 has a disc shape. The orbiting plate 52 faces the fixed plate 42. The orbiting spiral wall 53 extends straight from the orbiting plate 52 toward the fixed plate 42. The orbiting spiral wall 53 meshes with the fixed spiral wall 43. The orbiting spiral wall 53 is positioned inside the fixed outer peripheral wall 44. A clearance is secured between a distal end surface of the fixed spiral wall 43 and the orbiting plate 52, and a clearance is secured between a distal end surface of the orbiting spiral wall 53 and the fixed plate 42. Thus, the scroll compressor 10 includes a clearance between the fixed scroll 41 and the orbiting scroll 51 in the axial direction of the rotary shaft 12. The fixed spiral wall 43 is meshed with the orbiting spiral wall 53, so that a plurality of compression chambers 46 are defined.

As illustrated in FIG. 1, the boss portion 54 cylindrically protrudes from the orbiting plate 52 opposite to the fixed plate 42. An axial direction of the boss portion 54 corresponds to the axial direction of the rotary shaft 12.

The four recessed portions 55 are arranged around the boss portion 54 of the orbiting plate 52. The four recessed portions 55 are arranged in a peripheral direction of the rotary shaft 12 at regular intervals. Ring members 55*a* each having an annular shape are attached inside the recessed portions 55, respectively. An outer circumferential surface of each of the ring members 55*a* is in contact with an inner circumferential surface of each of the recessed portions 55. The anti-rotation pins 15*b* protruding from the compression housing 15 are inserted into the ring members 55*a* of the recessed portions 55, respectively.

An eccentric shaft 47 is disposed in the end surface 12*a* of the rotary shaft 12. The eccentric shaft 47 protrudes toward the orbiting scroll 51 from a position eccentric relative to an axial line L1 of the rotary shaft 12. An axial direction of the eccentric shaft 47 coincides with the axial direction of the rotary shaft 12. The eccentric shaft 47 is inserted in the boss portion 54. A bush 49 is fitted to an outer peripheral surface of the eccentric shaft 47. A balance weight 48 is integrated with the bush 49. The balance weight 48 is accommodated in the large diameter hole 16*b* of the compression housing 15. The orbiting scroll 51 is supported by the eccentric shaft 47 so as to be rotatable relative to the eccentric shaft 47 via the bush 49 and a bearing 50.

The scroll compressor 10 includes an oil supply passage 39 connecting the oil separation chamber 26 and the large diameter hole 16*b*. A first end of the oil supply passage 39 is connected to the oil separation chamber 26, and a second end of the oil supply passage 39 is connected to the large diameter hole 16*b*. The oil supply passage 39 extends through the discharge housing 24, the second bead 61*b* of the discharge gasket 61, the collar 42*a*, the second bead 35*b* of the gasket 35, and the compression housing 15.

In the scroll compressor 10 with the above-described configuration, the rotation of the rotary shaft 12 is transmitted to the orbiting scroll 51 via the eccentric shaft 47, the bush 49, and the bearing 50. At this time, each of the anti-rotation pins 15*b* comes in contact with the inner circumferential surface of each of the ring members 55*a*, which prevents the orbiting scroll 51 from rotating and allows the orbiting scroll 51 to revolve relative to the fixed scroll 41. As a result, the orbiting scroll 51 revolves while the orbiting spiral wall 53 is in contact with the fixed spiral wall 43 to reduce a volume of the compression chambers 46. In the present embodiment, the anti-rotation pins 15*b* and the recessed portions 55 including the ring members 55*a* form an anti-rotation mechanism.

The refrigerant drawn from the suction port 13*c* into the motor chamber 23 is drawn into an outermost peripheral portion of each of the compression chambers 46 via an outer peripheral side of the compression housing 15 and the introduction recess of the fixed scroll 41. The refrigerant drawn into the outermost peripheral portion of each of the compression chambers 46 is compressed inside the compression chambers 46 in response to the revolution of the orbiting scroll 51.

The refrigerant compressed in the compression chambers 46 passes through the discharge valve mechanism 45*a* and is discharged from the discharge hole 45 into the discharge chamber 30. The refrigerant discharged into the discharge chamber 30 is discharged into the oil separation chamber 26 through the discharge hole 28. Lubricating oil contained in the refrigerant discharged into the oil separation chamber 26 is separated from the refrigerant by the oil separator cylinder 31.

The refrigerant from which the lubricating oil is separated flows into the oil separator cylinder 31 and is discharged from the discharge port 27 into the external refrigerant circuit. The refrigerant discharged into the external refrigerant circuit flows back to the motor chamber 23 through the suction port 13*c*. On the other hand, the lubricating oil separated from the refrigerant by the oil separator cylinder 31 is supplied from the oil separation chamber 26 into the large diameter hole 16*b* through the oil supply passage 39.

Next, a structure in which the gasket 35 and the discharge gasket 61 are sandwiched will be described. FIG. 5 does not illustrate the fixed spiral wall 43, the fixed outer peripheral wall 44, and the discharge valve mechanism 45*a*, for illustration of only the fixed plate 42 and the collar 42*a*.

As illustrated in FIG. 2, FIG. 5, FIG. 6A and FIG. 6B the collar 42*a* includes a gasket contact surface 70, four protruding portions 71, and four metal contact surfaces 72 arranged in the protruding portions 71, respectively.

The gasket contact surface 70 and the distal end surface 18*a* of the compression housing 15 sandwich the gasket 35. Therefore, the gasket 35 is in contact with the gasket contact surface 70. The gasket contact surface 70 of the collar 42*a* corresponds to one of opposite surfaces of the collar 42*a* in the thickness direction of the collar 42*a*, facing the orbiting plate 52. The gasket contact surface 70 is provided on a position except for the four corners of the collar 42*a*.

The protruding portions 71 each protrude in a columnar shape from the four corners of the collar 42*a* toward the chamber forming peripheral wall 18. In the collar 42*a* as seen in the thickness direction, distances between the protruding portions 71 adjacent to each other are all the same. Thus, the four protruding portions 71 are arranged in the collar 42*a* at regular intervals.

The fourth bolt insertion holes 42*b* are opened in the protruding portions 71, respectively. That is, the fourth bolt insertion holes 42*b* are opened in the metal contact surfaces 72 of the protruding portions 71, respectively. Each of the metal contact surfaces 72 surrounds the corresponding fourth bolt insertion hole 42*b* in a distal end surface of each of the protruding portions 71. Each of the metal contact surfaces 72 is a flat surface. A dimension M from the gasket contact surface 70 to each of the metal contact surfaces 72 is the same for all the four metal contact surfaces 72. That is, all the four metal contact surfaces 72 are located at positions away from the gasket contact surface 70, respectively, by the same distance.

Figure 7:
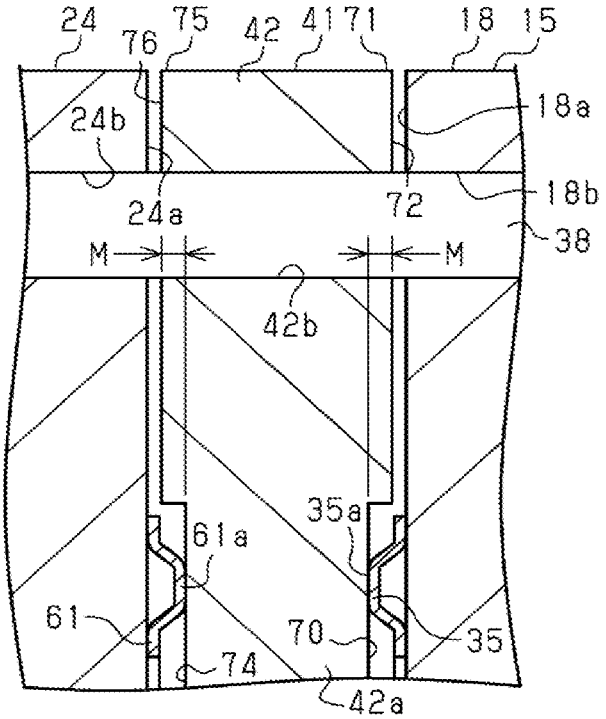
FIG. 7 is a cross-sectional view of a state before the gasket and the discharge gasket are sandwiched.

FIG. 7 illustrates a state before the fixed scroll 41 and the compression housing 15 are fixed to each other with the bolts 38. That is, such a state is a state before the metal contact surfaces 72 are in contact with the distal end surface 18*a*. The dimension M is smaller than a thickness of the gasket 35 before being sandwiched.

Figure 6A:
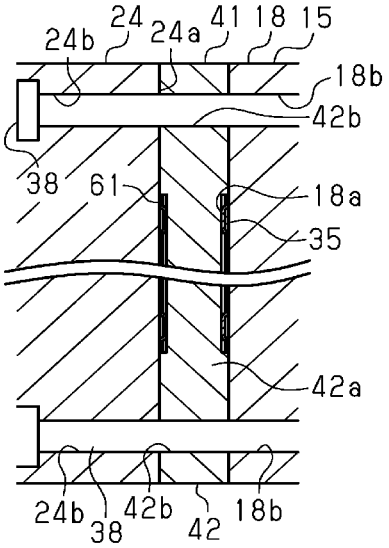
FIG. 6A is a cross-sectional view of a state in which the gasket and the discharge gasket are sandwiched.
Figure 6B:
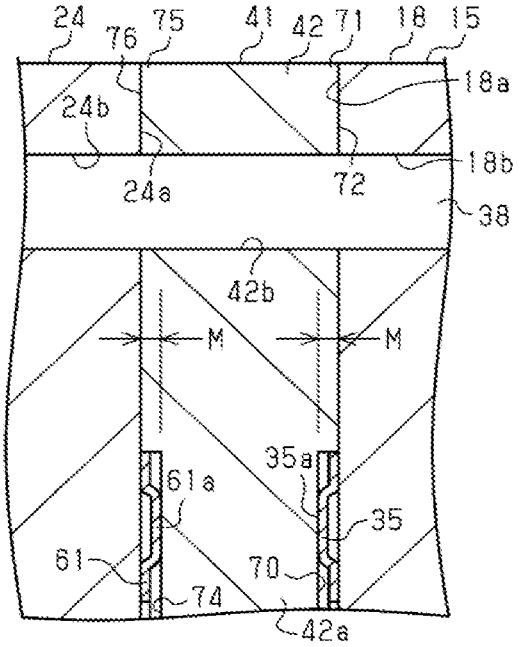
FIG. 6B is an enlarged view of the gasket and the discharge gasket.

As illustrated in FIG. 6B, each of the metal contact surfaces 72 of the collar 42*a* is in contact with the distal end surface 18*a* of the chamber forming peripheral wall 18. Each of the metal contact surfaces 72 is in contact with the distal end surface 18*a*, so that the gasket contact surface 70 is spaced from the distal end surface 18*a* in the axial direction of the rotary shaft 12. The gasket 35 is sandwiched between the gasket contact surface 70 and the distal end surface 18*a*. Thus, a contact portion of the distal end surface 18*a* of the chamber forming peripheral wall 18 with the metal contact surfaces 72 is a metal contact surface being in contact with the collar 42*a*, and a portion of the distal end surface 18*a* other than such a metal contact surface is a gasket contact surface. Therefore, each of the collar 42*a* and the compression housing 15 has the gasket contact surface with which the gasket 35 is in contact, and the metal contact surface on which the collar 42*a* and the compression housing 15 are in contact with each other. The collar 42*a* has the protruding portions 71 protruding in the axial direction of the rotary shaft 12 relative to the gasket contact surface 70, and the protruding portions 71 have the metal contact surfaces 72, respectively.

The first bead 35*a* of the gasket 35 is in contact with the gasket contact surface 70. The gasket 35 is sandwiched such that the first bead 35*a* is deformed by a certain deforming amount. The second bead 35*b* of the gasket 35 is in contact with the gasket contact surface 70 while surrounding the oil supply passage 39. The fourth bolt insertion holes 42*b* of the collar 42*a* are disposed outside an outer circumferential edge of the gasket 35.

As illustrated in FIG. 4, FIG. 5, FIG. 6A, and FIG. 6B, the fixed scroll 41 has a discharge gasket contact surface 74 on a side close to the discharge housing 24 in a thickness direction of the fixed scroll 41, four discharge protruding portions 75, and four discharge metal contact surfaces 76 arranged in the discharge protruding portions 75, respectively.

The discharge protruding portions 75 protrude in a columnar shape from the four corners of the collar 42*a* toward the discharge housing 24. That is, the fixed scroll 41 has the four discharge protruding portions 75 protruding toward the discharge housing 24 along the axial direction of the rotary shaft 12 relative to the discharge gasket contact surface 74. In the fixed scroll 41, the discharge protruding portions 75 have discharge metal contact surfaces 76, respectively. In the collar 42*a* as seen in the thickness direction of the collar 42*a*, the distances between the discharge protruding portions 75 adjacent to each other are all the same. Thus, the four discharge protruding portions 75 are arranged in the collar 42*a* at regular intervals.

The fourth bolt insertion holes 42*b* are opened in the discharge protruding portions 75, respectively. That is, the fourth bolt insertion holes 42*b* are opened in the discharge metal contact surfaces 76 of the discharge protruding portions 75, respectively. Each of the discharge metal contact surfaces 76 surrounds the corresponding fourth bolt insertion hole 42*b* in a distal end surface of each of the discharge protruding portions 75. Each of the discharge metal contact surfaces 76 is a flat surface. A dimension M from the discharge gasket contact surface 74 to each of the discharge metal contact surfaces 76 is the same for all the four discharge metal contact surfaces 76. That is, all the four discharge metal contact surfaces 76 are located at positions away from the discharge gasket contact surface 74, respectively, by the same distance.

As illustrated in FIG. 7, the dimension M is smaller than a thickness of the discharge gasket 61 before being sandwiched.

As illustrated in FIG. 6B, each of the discharge metal contact surfaces 76 of the collar 42*a* is in contact with the end surface 24*a* of the discharge housing 24. Each of the discharge metal contact surfaces 76 is in contact with the end surface 24*a*, so that the discharge gasket contact surface 74 is spaced from the end surface 24*a* in the axial direction of the rotary shaft 12. The discharge gasket 61 is sandwiched between the discharge gasket contact surface 74 and the end surface 24*a*. Thus, a contact portion of the end surface 24*a* of the discharge housing 24 with the discharge metal contact surfaces 76 is a metal contact surface being in contact with the collar 42*a*, and a portion other than such a metal contact surface is the discharge gasket contact surface 74.

The first bead 61*a* of the discharge gasket 61 protrudes toward the discharge gasket contact surface 74. The discharge gasket 61 is sandwiched such that the first bead 61*a* is deformed by a certain deforming amount. The second bead 61*b* of the discharge gasket 61 is in contact with the discharge gasket contact surface 74 while surrounding the oil supply passage 39.

In the above-mentioned embodiment, the following operations and effects can be obtained.

(1) The collar 42*a* and the chamber forming peripheral wall 18 of the compression housing 15 are fixed to each other in a state of approaching each other, due to the tightening with the plurality of bolts 38. The gasket 35 disposed between the gasket contact surface 70 and the distal end surface 18*a* of the chamber forming peripheral wall 18 is deformed to some extent while being in contact with the gasket contact surface 70 and the distal end surface 18*a*. The gasket contact surface 70 and the distal end surface 18*a* are spaced from each other by the protruding portions 71, by a certain distance in the axial direction of the rotary shaft 12. The metal contact surfaces 72 and the distal end surface 18*a* receive an axial force of each of the bolts 38, so that the distance between the gasket contact surface 70 and the distal end surface 18*a* is kept constant even when the axial force varies. As a result, a clearance between the distal end surface of the fixed spiral wall 43 and the orbiting plate 52, and a clearance between the distal end surface of the orbiting spiral wall 53 and the fixed plate 42, that is, a clearance between the fixed scroll 41 and the orbiting scroll 51 is kept constant. Thus, variations in a performance of the scroll compressor 10 is suppressed.

(2) The bolts 38 having passed through the discharge housing 24, the collar 42*a*, and the compression housing 15 are screwed into the motor housing 13. Thus, the discharge housing 24, the collar 42*a*, the compression housing 15, and the motor housing 13 are pushed and fixed to each other in the axial direction of the rotary shaft 12. This suppresses vibration of the housing 11. In such a housing 11, variations in the axial force of the bolts 38 is likely to occur. However, the protruding portions 71 are provided in the collar 42*a*, and the metal contact surfaces 72 are in contact with the distal end surface 18*a* of the chamber forming peripheral wall 18, which suppresses reduction in the performance of the scroll compressor 10 due to the variations in the axial force of the bolts 38. Thus, reduction in the performance of the scroll compressor 10 is suppressed while suppressing vibration.

(3) The protruding portions 71 are arranged at the four corners of the collar 42*a*, respectively, at regular intervals. Thus, the four metal contact surfaces 72 allows the distance between the gasket contact surface 70 and the distal end surface 18*a* over the entire circumference to be easily kept constant. Therefore, the entire circumference of the gasket 35 is pushed and deformed uniformly.

(4) The protruding portions 71 protrude from the gasket contact surface 70 of the collar 42*a*. Since the collar 42*a* has a rectangular plate shape, the protruding portions 71 are easily processed and formed as compared with the chamber forming peripheral wall 18 having a tubular shape.

(5) The metal contact surfaces 72 are provided around the fourth bolt insertion holes 42*b*, respectively. Thus, the metal contact surfaces 72 easily receive the axial force of the bolts 38.

(6) The metal contact surfaces 72 of the protruding portions 71 are formed around the fourth bolt insertion holes 42*b*, respectively. The fourth bolt insertion holes 42*b* are portions required when the compression housing 15, the collar 42*a*, the motor housing 13, and the discharge housing 24 are fixed to each other with the bolts 38, and each have an existing structure in the scroll compressor 10. Since the protruding portions 71 and the metal contact surfaces 72 are provided utilizing such an existing structure, variations in the performance of the scroll compressor 10 are suppressed while suppressing an increase in a size of the scroll compressor 10.

(7) The fourth bolt insertion holes 42*b* are arranged outside an outer circumferential edge of the gasket 35. Thus, airtightness of the fourth bolt insertion holes 42*b* need not be ensured, so that the number of components of the scroll compressor 10 does not increase.

(8) The discharge gasket 61 is sandwiched between the discharge housing 24 and the collar 42*a*. The discharge protruding portions 75 that protrude from the discharge gasket contact surface 74 toward the discharge housing 24 and receive the axial force of the bolts 38 are provided in the collar 42*a*. The discharge metal contact surfaces 76 being in contact with the end surface 24*a* of the discharge housing 24 are provided in the discharge protruding portions 75, respectively. Since the discharge housing 24 is fixed with the bolts 38, the axial force of the bolts 38 is also applied to the discharge housing 24. At this time, since the discharge metal contact surfaces 76 receive the axial force of the bolts 38, deformation of the discharge housing 24 due to the axial force of the bolts 38 is suppressed.

(9) The protruding portions 71 and the metal contact surfaces 72 are provided at the four corners of the collar 42*a*. The collar 42*a* is downsized without impairing a function of the protruding portions 71 and the metal contact surfaces 72, as compared with a case in which the protruding portions 71 and the metal contact surfaces 72 surround the entire gasket 35 from the outer circumferential side thereof.

(10) The collar 42*a* includes the protruding portions 71 and the metal contact surfaces 72 suppressing variations in the performance of the scroll compressor 10, and the discharge protruding portions 75 and the discharge metal contact surfaces 76 suppressing deformation of the discharge housing 24. Only processing the collar 42*a* of the fixed scroll 41 exerts an effect suppressing variations in the performance of the scroll compressor 10 and an effect suppressing deformation of the discharge housing 24.

The present embodiment may be modified and implemented as follows. The above-mentioned embodiment may be combined with the following modified embodiments within a technically consistent range.

Figure 8:
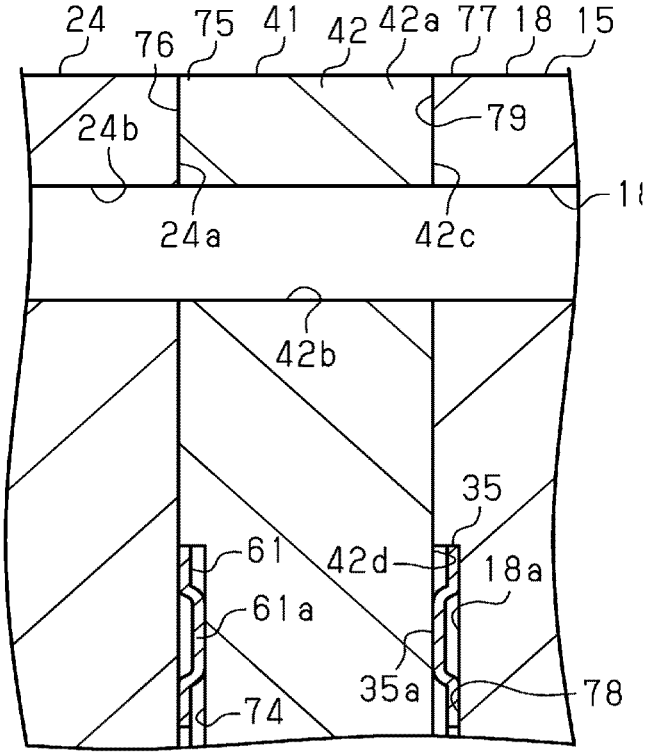
FIG. 8 is a cross-sectional view of another example.

As illustrated in FIG. 8, a protruding portion 77 protruding from the four corners of the distal end surface 18*a* of the chamber forming peripheral wall 18 toward the collar 42*a* may be provided. Then, a gasket contact surface 78 is provided on the distal end surface 18*a* of the chamber forming peripheral wall 18, and a metal contact surface 79 is provided on the protruding portion 77. In this case, the protruding portion 71 is not formed in the collar 42*a*, and parts of the four corners of the collar 42*a* being in contact with the metal contact surface 79 of the protruding portion 77 protruding from the chamber forming peripheral wall 18 are a metal contact surface 42*c*. Parts of the collar 42*a* other than the metal contact surface 42*c* are a gasket contact surface 42*d*.

Figure 9:
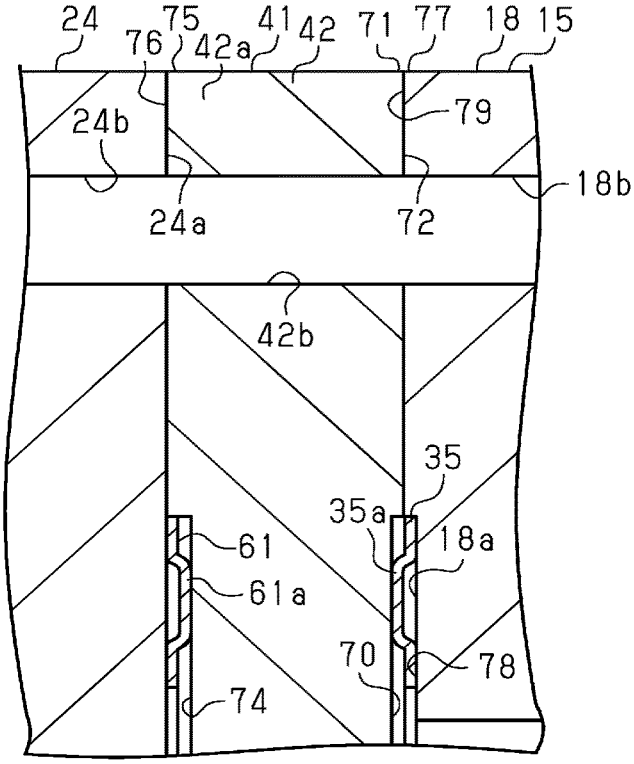
FIG. 9 is a cross-sectional view of another example.

As illustrated in FIG. 9, the protruding portion 71 and the metal contact surface 72 may be provided in the collar 42*a*, and the protruding portion 77, the gasket contact surface 78, and the metal contact surface 79 may be also provided on the distal end surface 18*a* of the chamber forming peripheral wall 18.

Then, the gasket 35 is sandwiched between the gasket contact surface 70 of the collar 42*a* and the gasket contact surface 78 of the chamber forming peripheral wall 18. The metal contact surface 72 of the collar 42*a* is in contact with the metal contact surface 79 of the chamber forming peripheral wall 18.

The discharge protruding portion 75 and the discharge metal contact surface 76 of the collar 42*a* need not be formed.

The fourth bolt insertion holes 42*b* of the collar 42*a* may be provided inside an inner circumferential edge of the gasket 35. In this case, airtightness around the fourth bolt insertion holes 42*b* is secured by an O-ring or a half bead provided in a part of the gasket 35.

Positions of the protruding portions 71 and the metal contact surfaces 72 may be changed. As an example, the protruding portions 71 may be provided inside the inner circumferential edge of the gasket 35. In this case, peripheral portions of the fourth bolt insertion holes 42*b* are positioned on the same surface as the gasket contact surface 70.

The protruding portions 71 may each have an annular shape surrounding the gasket 35. In this case, the metal contact surface 72 also has an annular shape surrounding the gasket 35.

A bead extending over the entire circumference of the gasket 35 other than the first bead 35*a* may be provided.

Although the gasket 35 is disposed such that the first bead 35*a* is in contact with the gasket contact surface 70 of the collar 42*a*, the first bead 35*a* may be in contact with the distal end surface 18*a* of the chamber forming peripheral wall 18.

Although the discharge gasket 61 is disposed such that the first bead 61*a* is in contact with the gasket contact surface 70 of the collar 42*a*, the first bead 61*a* may be in contact with the end surface 24*a* of the discharge housing 24.

Next, technical ideas that can be obtained from the above-described embodiment and the modified embodiments are added as follows.

(I) The housing includes an oil supply passage connecting a discharge pressure area and an accommodation chamber, and the gasket includes a half bead securing airtightness of the oil supply passage.

REFERENCE SIGNS LIST

10 scroll compressor
12 rotary shaft
15 compression housing
18*a* distal end surface including gasket contact surface and metal contact surface
18*b* second bolt insertion hole
24 discharge housing
24*a* end surface as discharge gasket contact surface
24*b* third bolt insertion hole
35 gasket
38 bolt
41 fixed scroll
42*a* collar
42*b* fourth bolt insertion hole
42*c* metal contact surface
42*d* gasket contact surface
51 orbiting scroll
61 discharge gasket
70 gasket contact surface
71 protruding portion
72 metal contact surface
74 discharge gasket contact surface
75 discharge protruding portion
76 discharge metal contact surface
77 protruding portion
78 gasket contact surface
79 metal contact surface

The invention claimed is:

1. A scroll compressor comprising:
a rotary shaft;
a fixed scroll;
an orbiting scroll revolving relative to the fixed scroll;
a compression housing accommodating the fixed scroll and the orbiting scroll;
a discharge housing disposed at a position opposite to the compression housing such that a collar of the fixed scroll is sandwiched by the discharge housing and the compression housing;
a gasket sandwiched by the collar and the compression housing to seal a gap between the collar and the compression housing; and
a plurality of bolts fixing the compression housing, the fixed scroll, and the discharge housing in an axial direction of the rotary shaft, wherein
each of the collar and the compression housing includes a gasket contact surface with which the gasket is in contact, and a metal contact surface on which the collar and the compression housing are in contact with each other to receive an axial force of each of the bolts,
at least one of the collar and the compression housing includes a protruding portion protruding in the axial direction relative to the gasket contact surface, and
the metal contact surface is disposed on the protruding portion.

2. The scroll compressor according to claim 1, wherein
each of the compression housing, the fixed scroll, and the discharge housing includes a plurality of bolt insertion holes through which the plurality of bolts are inserted, respectively, and
each of the bolt insertion holes is opened in the metal contact surface of the protruding portion.

3. The scroll compressor according to claim 2, wherein
the bolt insertion holes are disposed outside an outer circumferential edge of the gasket.

4. The scroll compressor according to claim 1 further comprising:
a discharge gasket sandwiched between the fixed scroll and the discharge housing to seal a gap between the fixed scroll and the discharge housing, wherein
each of the fixed scroll and the discharge housing includes a discharge gasket contact surface with which the discharge gasket is in contact,
the fixed scroll includes a discharge protruding portion protruding toward the discharge housing in the axial direction relative to the discharge gasket contact surface, and
the discharge protruding portion has a discharge metal contact surface on which the discharge protruding portion is in contact with the discharge housing to receive an axial force of each of the bolts.

* * * * *